US005803478A

United States Patent [19]

Gavalis

[11] Patent Number: 5,803,478

[45] Date of Patent: Sep. 8, 1998

[54] SKI

[76] Inventor: Richard Clifford Gavalis, 79 Paul Lemen Dr., Valley Forge, Pa. 19481

[21] Appl. No.: 472,124

[22] Filed: Jun. 7, 1995

[51] Int. Cl.[6] ..... A63C 5/00

[52] U.S. Cl. ..... 280/601; 280/602; 280/610

[58] Field of Search ..... 280/601, 602, 280/609, 610; 428/192, 220, 332, 337, 464, 537.1

[56] References Cited

U.S. PATENT DOCUMENTS

| | | |
|---|---|---|
| 2,375,504 | 5/1945 | Svensson . |
| 2,918,293 | 12/1959 | Tavi . |
| 3,104,888 | 9/1963 | Day et al. . |
| 3,300,226 | 1/1967 | Reed . |
| 3,398,968 | 8/1968 | Mutzhas . |
| 3,747,947 | 7/1973 | Gunzel . |
| 3,819,198 | 6/1974 | Groves . |
| 3,884,315 | 5/1975 | Fox . |
| 4,071,264 | 1/1978 | Legrand et al. . |
| 4,199,169 | 4/1980 | Guenzel et al. . |
| 4,221,400 | 9/1980 | Powers . |
| 4,300,786 | 11/1981 | Alley . |
| 4,358,130 | 11/1982 | Adams . |
| 4,530,511 | 7/1985 | Brandt, III . |
| 4,577,886 | 3/1986 | Chernega . |
| 4,592,567 | 6/1986 | Sartor . |
| 4,600,211 | 7/1986 | Schmidt . |
| 4,844,499 | 7/1989 | Baumann . |
| 4,858,945 | 8/1989 | Kashiwa ..... 280/610 |
| 4,895,388 | 1/1990 | Richmond . |
| 5,035,442 | 7/1991 | Arnsteiner . |
| 5,167,424 | 12/1992 | Baggio et al. . |
| 5,211,418 | 5/1993 | Scherübl . |
| 5,217,243 | 6/1993 | Recher et al. . |
| 5,251,924 | 10/1993 | Nussbaumer . |
| 5,303,948 | 4/1994 | Le Masson et al. . |
| 5,332,252 | 7/1994 | Le Masson et al. . |

OTHER PUBLICATIONS

"Saving Your Knees," Part I by Cliff Meader and Part II by Carl Ettinger. *Skiing*, Mar./Apr. 1995, pp. 30–32.

*Primary Examiner*—Richard M. Camby
*Attorney, Agent, or Firm*—Ratner & Prestia

[57] ABSTRACT

A ski is provided including a front tip and a rear tail, wherein a shovel portion is defined adjacent the ski tip and a tail portion is defined adjacent the ski tail. A middle portion of the ski is located between the tip and tail portions. The middle portion is very stiff, and the tail portion is very flexible. The peak stiffness coefficient of the middle portion is at least 200,000 lb-in$^2$. There is no upper limit to the stiffness of the middle portion. The tail portion of the ski has a peak stiffness coefficient of less than 10 percent of the peak stiffness coefficient of the middle portion of the ski. The peak stiffness coefficient of the tail portion of the ski is less than 20,000 lb-in$^2$. The high stiffness of the middle section of the ski is preferably achieved through the use of at least two carbon graphite fiber plates (or similar stiff material) incorporated into the body of the middle and shovel portions of the ski.

13 Claims, 6 Drawing Sheets

SKI

DESCRIPTION OF THE RELATED ART

Existing ski designs are not easily used by recreational skiers who, on average, ski only 5–12 days per year. The existing skis are designed to be skied in relatively long lengths and are targeted to specific snow conditions. For example, the recreational skier would generally improve his or her skiing performance (and, therefore, skiing enjoyment) if the skier owned several pairs of skis and switched between a pair designed to ski powder, a second pair designed to ski chopped powder and broken snow, a third pair designed to ski eastern hard-packed snow, and a fourth pair designed to ski eastern crust and ice. Further, the recreational skier would also experience an increase in performance if these skis were each skied in a different length. Therefore, it is apparent that the recreational skier would have to spend inordinate sums of money to enjoy skiing, although such a skier skis only 5–12 days per year.

Existing ski designs and skier preferences require a ski shop to carry numerous lengths of skis in each ski design. Such skis are often stocked in lengths between 150 cm and 205 cm in 5 cm increments. Further, each ski shop must carry skis from up to five manufacturers. Each manufacturer will likely manufacture numerous models for skiers of different abilities. These skis (for differing skier ability) usually have varying degrees of stiffness over the length of the ski. Skis with stiff tail sections are generally better for higher level, more aggressive skiers. Skis having softer (more flexible) tail portions are generally better for less experienced, less aggressive skiers.

To stock such an inventory is cost prohibitive for may ski shops. As a result, ski shops may not stock all lengths of skis for all skier ability levels. As a result, shops will stock many skis that are unsuitable in either length or design for a particular skier. Further, the shop may very well run out of the skis which are most suited to a particular skier. A ski shop tends to sell what it has, and if the appropriate ski is not readily available, a ski which the shop has in stock will generally be substituted, providing it is not too different from the desired ski.

Previous ski designs have modified ski performance by altering the stiffness of skis using plates. Specifically these plates have altered the stiffness of the shovel and tail, or the entire ski. However, these attempts have required the skier to substitute different stiffening plates for differing snow conditions. Moreover, such prior art ski designs have stiff tails which can make the ski difficult to turn and contribute to knee injuries in a large number of skiers.

Studies of skiing injuries indicate that the stiff tails in existing ski designs contribute to a large number of ski injuries. Specifically, the stiff tail of existing skis can act as a lever to apply unusually high twisting and bending loads to the knee of a skier when the skier falls, resulting in ligament damage.

Previous attempts to prevent the ski tail from acting as a lever include the use of a spring mechanism to allow the tail section of the ski to pivot upward during rearward twisting falls. However, the use of a ski with a spring mechanism significantly hampers performance of the ski in that when the spring hinge opens, a large gap in the ski base is exposed. This large gap results in an increased drag on the ski and uneven pressure points along the base of the ski. Further, designing a spring which will maintain the ski in an unbroken condition when being skied, but will allow the ski to flex when a skier falls, is very difficult. Springs might also need to be varied depending on the skier's size and ability. Such designs have generally proven impractical and ineffective for the reasons set forth above.

Further, traditional ski designs uniformly feature stiffer tail sections for more advanced skiers. The reasoning is generally that the stiffer tail propels the skier from one turn into the next, and that without the stiff tails, turning the skis quickly would be difficult or impossible. Thus the concept of a flexible tail section is directly contrary to existing ski designs.

Recently, skis without tails have been manufactured. These skis end just behind the boots of the skier. The short skis have the great disadvantage that they lack stability at high speeds. Further, in deep loose or powder snow, if a skier using such a shortened ski stops, there is a tendency to sink into the snow, with the tips of the skis pointed upwards. This is an uncomfortable position and the skier must "climb" out of the snow to continue skiing.

Accordingly, it would be advantageous to produce a ski which reduces the varieties of length and stiffness characteristics needed to accommodate substantially all ability levels of skiers. Similarly, it would be desirable to produce a ski which reduced the likelihood of knee injuries, as that is one of the most prevalent injuries to skiers, while being a stable ski which is easy to ski.

SUMMARY OF THE INVENTION

In accordance with the present invention a ski is provided including a front tip and a rear tail, wherein a shovel portion is defined adjacent the ski tip and a tail portion is defined adjacent the ski tail. A middle portion of the ski is located between the tip and tail portions. The middle portion is very stiff, and the tail portion is very flexible. The peak stiffness coefficient of the middle portion is at least 200,000 lb-in$^2$. There is no upper limit to the stiffness of the middle portion. The tail portion of the ski has a peak stiffness coefficient of less than 10 percent of the peak stiffness coefficient of the middle portion of the ski. The peak stiffness coefficient of the tail portion of the ski is less than 20,000 lb-in$^2$. The high stiffness of the middle section of the ski is preferably achieved through the use of at least two carbon graphite fiber plates (or similar stiff material) incorporated into the body of the middle and shovel portions of the ski.

The high stiffness in the middle section of the ski significantly contradicts existing design philosophy of having considerable flexibility in the boot and binding area. Many of the existing designs attempt to isolate the stiffening effect of the boot and binding. The present invention welcomes any stiffness contribution of the boot and binding. Accordingly, the present invention has a considerably different stiffness distribution along the length of the ski. This is in direct contrast with existing design concepts and resulting designs.

DETAILED DESCRIPTION OF THE PREFERRED EMBODIMENTS

Figure 1A:
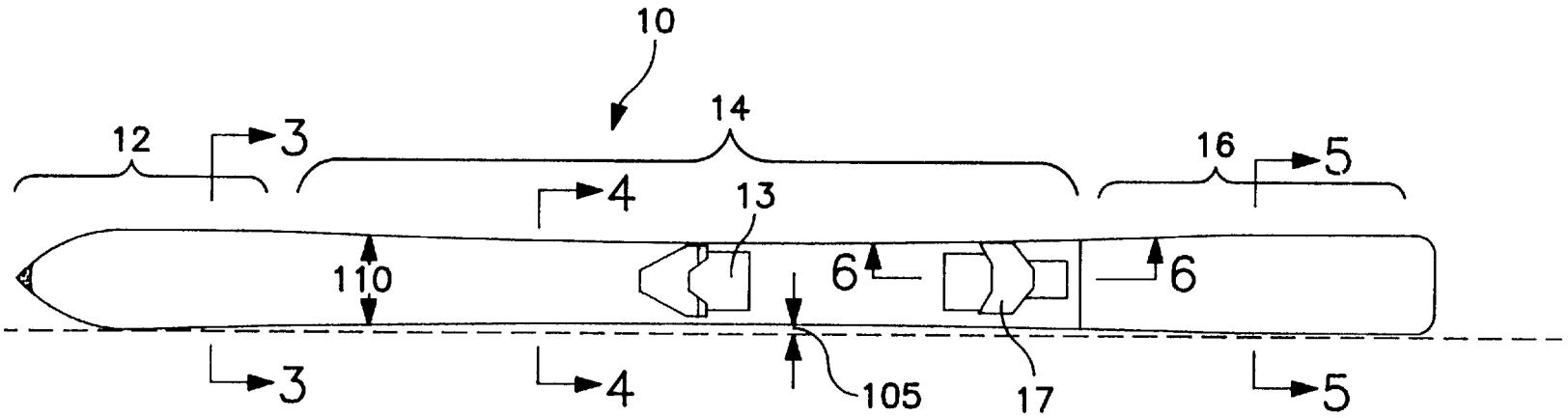
FIG. 1A is a plan view of the ski of the present invention.
Figure 1B:
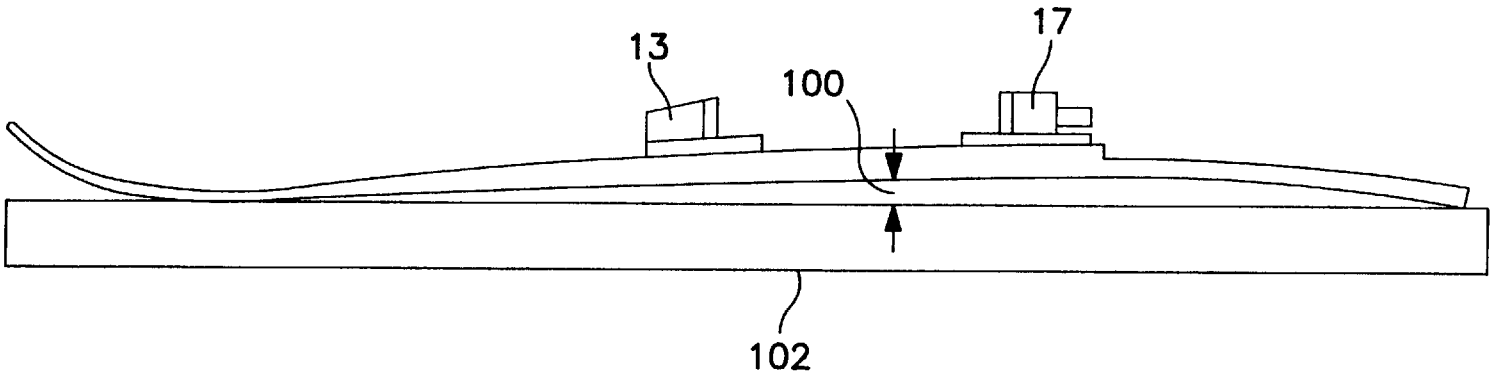
FIG. 1B is a side view of the ski of the present invention.

With reference to FIG. 1, ski 10 includes shovel portion 12, middle portion 14, and tail portion 16. Generally, shovel portion 12 refers to that portion of the ski beginning at the tip of the ski and extending about 20% of the length of the ski. The boot is positioned on the ski such that the toe of the boot is at a point about 48–50% of the way from the tip to the tail of the ski. The position of the heel of the boot will therefore vary somewhat depending of the size of the boot, shorter boots will end farther forward than smaller boots. The placement of the rear binding 17 will therefore vary from skier to skier.

Likewise, tail portion 16 generally refers to that portion of the ski between the rear binding and the back end of the ski. Since placement of a boot on a ski is most often predetermined based on the position of the toe of the boot, persons with small feet will have a rear binding placed slightly more forward on the ski than normal. Thus the tail portion 16 may start somewhat behind the rear binding of the ski. However, tail portion 16 almost always comprises the rearmost 25–35% of the ski. Of course, middle portion 14 of ski 10 is that portion of the ski which falls between shovel portion 12 and tail portion 16.

Ski 10 has camber 100 which is an upward arch at the middle of the ski causing the skier's weight to be distributed evenly along the length of the ski when gliding. Camber 100 also allows ski 10 to flatten when pressure is applied while a skier makes a turn. Once the turn is complete, the ski snaps back to a slightly curved position, accelerating the skier into the next turn. In this case, camber 100 can be in the range of a traditional ski at around 1–2 cm. However, little or no camber is needed for the ski of the present invention. In fact, due to the high stiffness of the ski, less camber is preferred. Thus the camber should be no more than 1 cm, and preferably no more than 0.6 cm.

Length 102 of ski 10 is in the range of the length of a traditional adult ski, varying in length from about 140 cm to about 210 cm, although lengths in excess of 160 cm are seldom necessary with the present ski.

Ski 10 may also have a side cut 105 which is a concave curvature along the lateral edges of ski 10 as shown in FIG. 1A. When the ski is placed on its edge, and compressed, the side cut determines the turning arc of the ski and distributes pressure along the length of the ski.

Ski 10 has flexural and torsional stiffness which determine the unusual properties of the ski of the present invention. Torsional stiffness refers to the ability of ski 10 to resist twisting about a center axis running along the length of ski 10. Flexural stiffness refers to the ability of the ski to resist bending about a line across of the width of the ski such as line 4—4 in FIG. 1. The stiffness of the ski of the present invention will be discussed in more detail below. While the composition of a ski made in accordance with the present invention will affect the torsional stiffness of the ski, of greatest importance in the present invention is the flexural stiffness of the ski. The discussion of the stiffness of the ski of the present invention will therefore focus on the flexural stiffness of the ski. Any unqualified reference herein to stiffness thus refers to the flexural stiffness of the ski.

Figure 3:
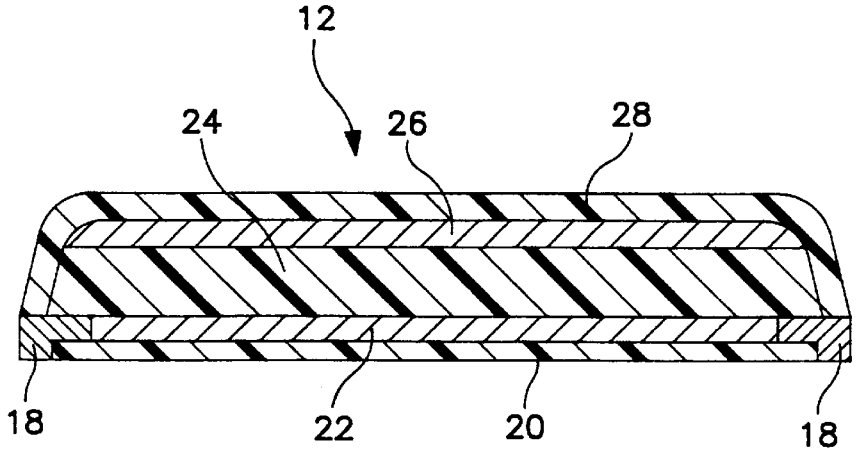
FIG. 3 is a cross-sectional view of the ski of the present invention taken along a line 3—3 of FIG. 1.
Figure 4:
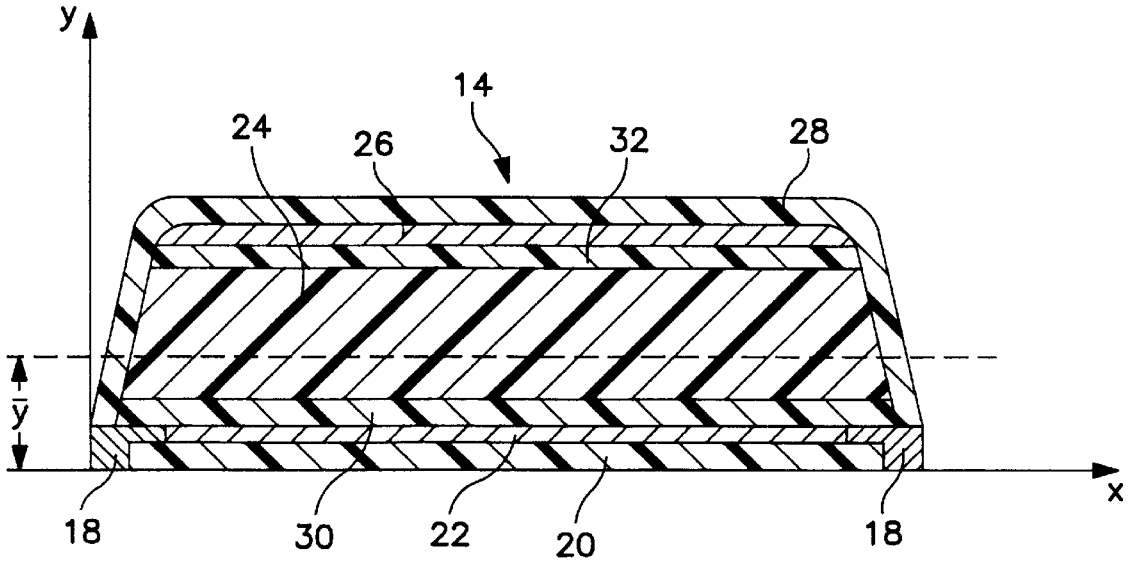
FIG. 4 is a cross-sectional view of the ski of the present invention taken along the line 4—4 of FIG. 1.

The composition of ski 10 can be seen from FIGS. 3 and 4. Typically, ski 10 includes the following components: edges 18; base 20; lower sport plate 22; and protective cap 28. These elements extend along the entire length of ski 10. Although FIG. 3 shows protective cap 28 meeting edges 18, protective cap 28 can also extend over only the upper surface of ski 10. This leaves the ends of the lower layers exposed. In addition to those elements above, shovel portion 12 and middle portion 14 also include the following elements: core 24 and upper support plate 26. Additionally, middle portion 14 also includes lower stiffening plate 30 and upper stiffening plate 32.

Figure 5:
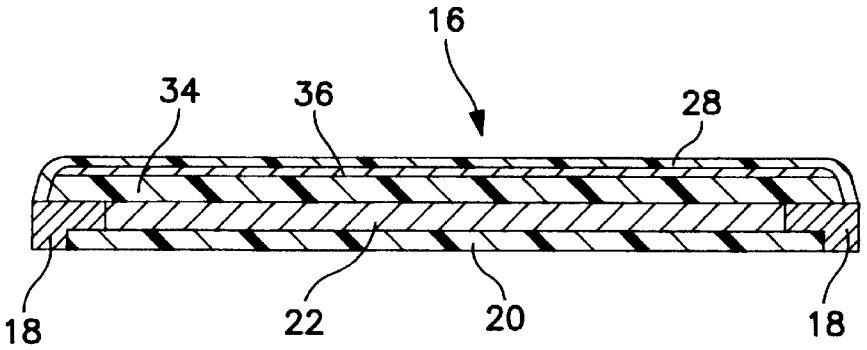
FIG. 5 is a cross-sectional view of the ski of the present invention taken along the line 5—5 of FIG. 1.
Figure 6:
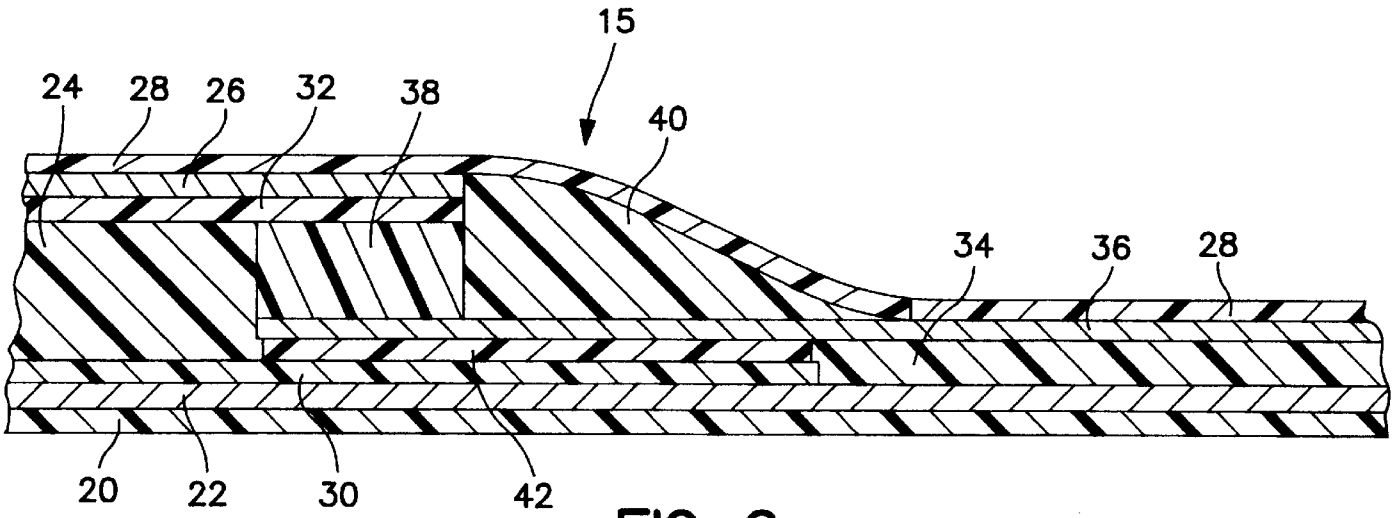
FIG. 6 is a cross-sectional view of the ski of the present invention taken along the line 6—6 of FIG. 1.

With reference to FIGS. 5–6, tail portion 16 of ski 10 includes tail portion core 34 and tail portion upper support plate 36. The difference in composition between tail portion 16 and middle portion 14 of ski 10 necessitates a transitional area between the two portions, as shown in FIG. 6. This transition area includes a shear block 38, transition core 40, and bonding layer 42. This is in addition to those layers recited for middle portion 14 and tail portion 16 of ski 10.

The different elements of ski 10 are formed from differing materials. Edges 18 are generally made of steel or other similarly hard material. The edges are used for controlling the ski during turning of the ski, especially on hard packed snow or ice. Accordingly, the edges must be capable of being sharpened, and steel is generally the material of choice. Base 20 is generally formed of a polymeric or similar material which helps provide low friction contact between ski 10 and the snow surface. The material used readily accept wax in order to further reduce friction with the snow. Lower support plate 22 and upper support plate 26 are often formed from aluminum or other similar material and provide some limited flexural and torsional stiffness to ski 10.

Protective cap 28 is generally formed from a thermoplastic material and acts as a cosmetic and abrasion-resistant layer that helps to preserve the appearance of ski 10 by resisting scratches and dents. Core 24 is traditionally often formed from wood, although plastic and even cellular aluminum have been used. Edges 18, base 20, support plates 22 and 26, and protective cap 28 are all conventional elements incorporated into prior art skis. The composition and configuration of these elements in the present invention is conventional. One skilled in the art would be able to design appropriate elements for a ski.

However, prior art skis lack stiffening plates 30 and 32 as explained below. Lowering stiffening plate 30 and upper stiffening plate 32 are formed from a very rigid and stiff material which has a high modulus of elasticity. Preferably, that material is a graphite carbon fiber composite or a similar material having a very high modulus of elasticity. Stiffening plates 30 and 32 increase substantially the flexural and torsional stiffness along middle portion 14 of ski 10. Indeed, the stiffness coefficient should be at least two or more times the stiffness coefficient of a prior art ski.

Figure 2:
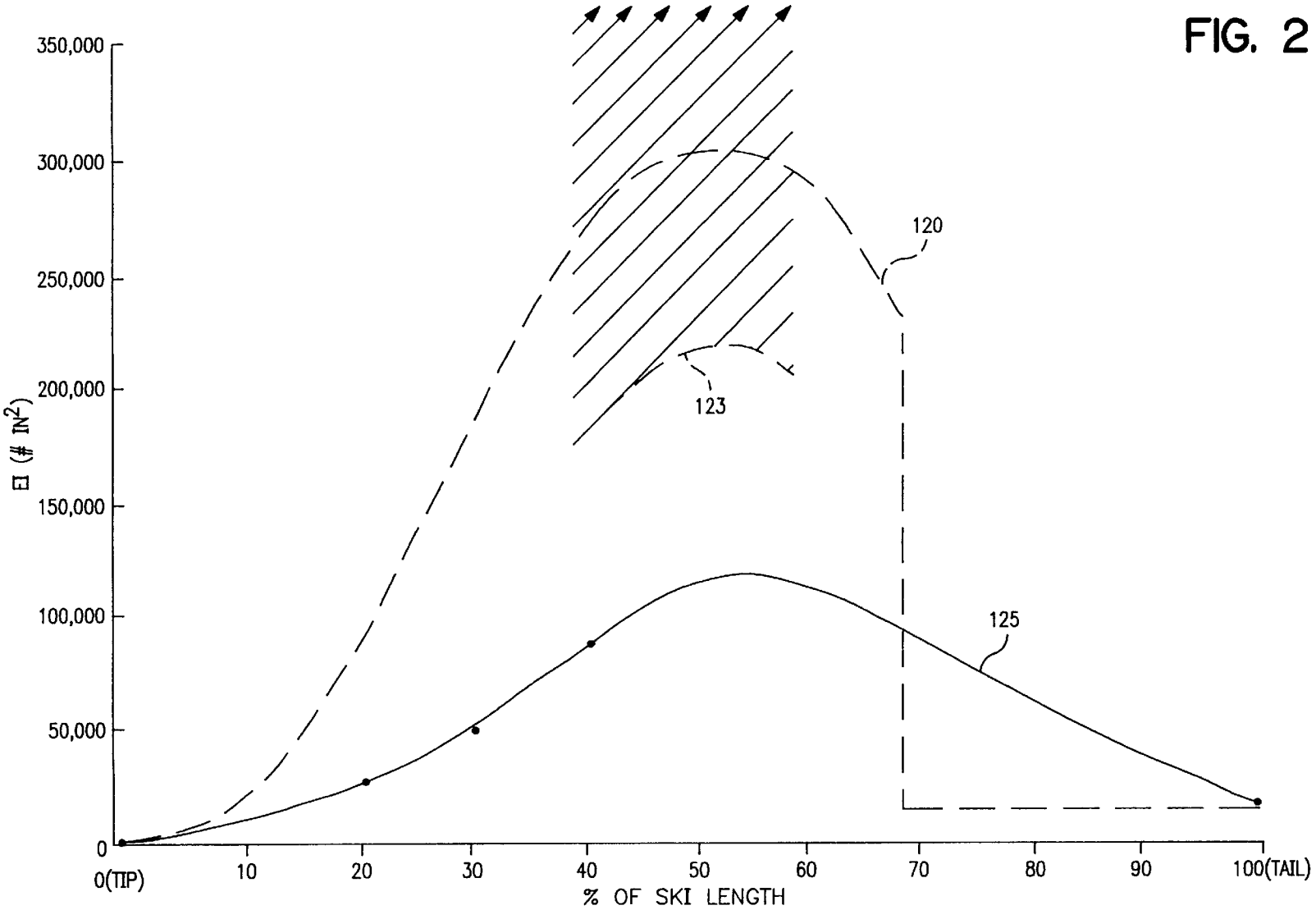
FIG. 2 is a graph of the stiffness of the ski of the present invention versus the distance from the tip of the ski.

Specifically, FIG. 2 shows the stiffness coefficient of the ski of the present invention as well as the stiffness coefficient of a prior art ski versus the distance from the tip of the ski. The distance from the tip of the ski is calculated as a percentage of the ski length. Line 120 represents the stiffness coefficient of the ski of the present invention. Line 125 represents the stiffness coefficient of a typical prior art ski. The shaded area 123 represents the range of stiffness of the ski of the present invention.

As can be seen from the figure, the stiffness coefficient of the ski of the present invention is considerably higher, and nearly three times that of the prior art ski in middle portion 14. The extreme stiffness of middle portion 14 of the ski of the present invention is achieved through the use of stiffening plates 30 and 32 which have a very high modulus of elasticity.

As can also be seen from FIG. 2, the stiffness of the tail portion of the ski (that is about the last 25–35 percent of the length of the ski) is much lower than that of a conventional ski. The calculated stiffness coefficient of the tail portion of the ski as shown in FIG. 2 is only about one-thirtieth (1/30) of the peak stiffness in middle portion 14 of ski 10. Because the stiffness coefficient is so low, it is difficult to differentiate the stiffness coefficient from FIG. 2. Accordingly, that portion of the curve from FIG. 2 which relates to tail portion 16 of ski 10 has been expanded and is shown in FIG. 8.

Figure 8:
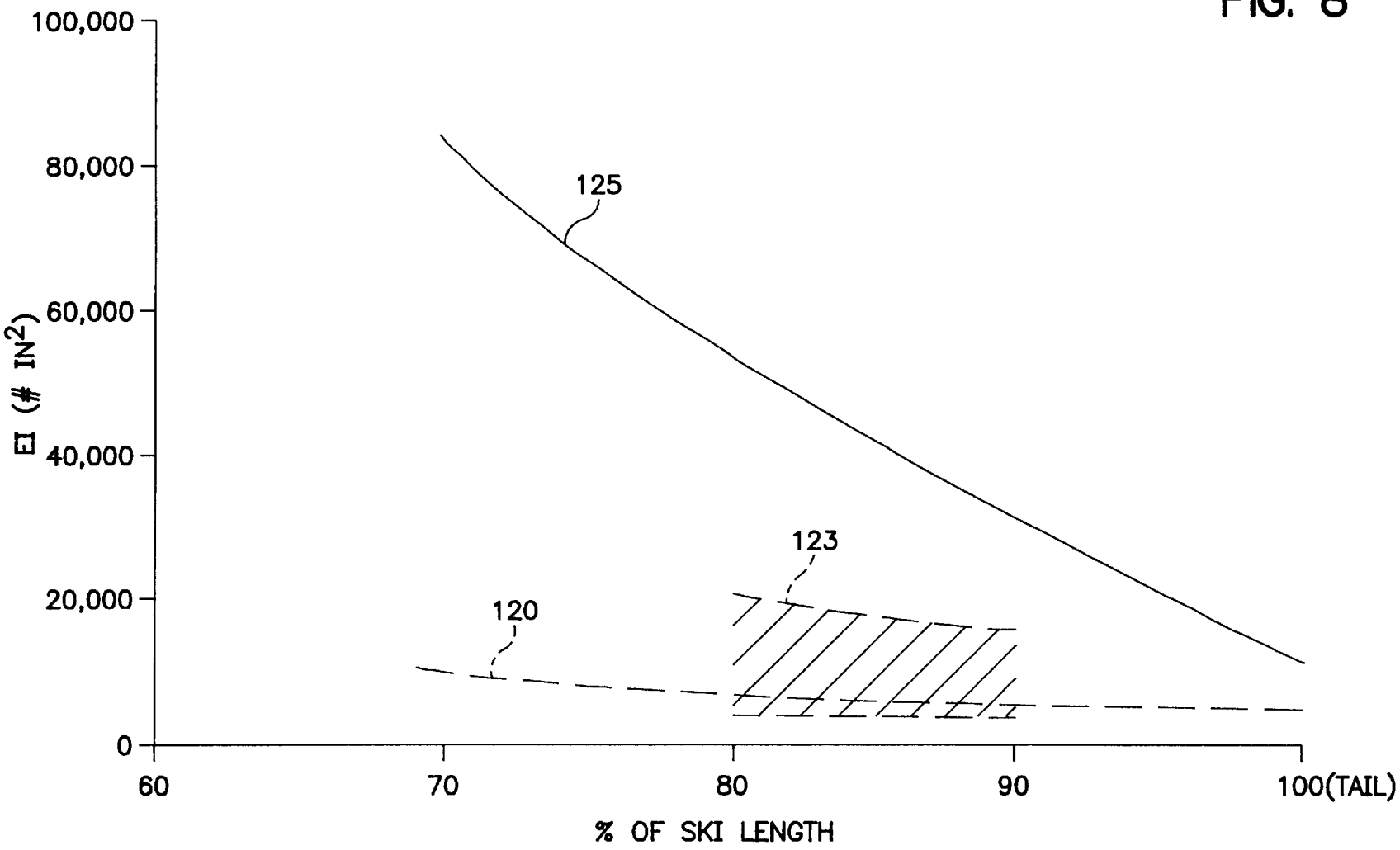
FIG. 8 is an expanded view of a portion of the graph in FIG. 2, showing the stiffness of the tail portion of the ski of the present invention versus distance from the tip of the ski.

As can be seen from FIG. 8, the peak stiffness coefficient in tail portion 16 of ski 10 is about 10,000 lb-in$^2$. Even in the maximum range of stiffness coefficients (as shown by line 123), the peak stiffness coefficient of ski 10 in tail portion 16 is only about 20,000 lb-in$^2$, with an even lower average stiffness coefficient. This compares with a conventional ski, shown as curve 125, where the stiffness coefficient in the tail portion 16 exceeds 80,000 lb-in$^2$. The transition from middle portion 14 to tail portion 16 of ski 10 as shown in FIG. 2, is dramatic. At the transition portion, the curve 120 drops nearly straight down evidencing a very sharp transition from stiffness in the mid-portion of the ski to stiffness in the tail portion 16 of ski 10. This is achieved through transition areas 15 and 15*a* of ski 10.

Flexible tail portion 16 is very important to the operation of ski 10. Specifically, the highly flexible tail portion provides almost no resistance to turning a ski on snow or ice. This permits the skier to turn the ski much more easily on snow and ice than would otherwise be possible. Further, it virtually eliminates the need to compress the ski and rather allows the ski to turn just by putting it on its edge, which includes side cut 105.

Because tail portion 16 is so flexible, a skier may not "sit back" on his or her skis and pressurize the tail section. This forces the skier to keep his or her weight forward, over the skier's boots, to prevent falling backwards off the ski. Keeping the weight forward is important to proper ski control. Thus, this aids in instructing a skier to ski properly.

Furthermore, if the skier does shift his or her weight to the back of the ski, and consequently loses control of ski 10, with prior art skis, falling backwards could be likely to cause severe knee injuries. With the ski of the present invention, because the tail is so flexible, the ski is less likely than a conventional ski to cause such knee injuries. In this case, the ski would bend instead of placing tremendous pressure on the skier's knees, and thus serious knee injury would be averted.

The stiffness coefficient (EI) shown in FIG. 2 is a calculated coefficient based on the materials used in making the skis. Referring now to FIG. 4, the stiffness coefficient (EI) is the product of the modulus of elasticity of the material (E) (lb/in$^2$) and I, the moment of inertia of the cross section of the material (in$^4$).

The calculation for the section shown in FIG. 4 is as follows: first the width and thickness of each component is determined. For the edges 18, the width (W) is 0.357 inches and the thickness (T) is 0.060 inches. The distance Y from a reference X axis is determined. In this case, the bottom of the ski was used as the reference X axis. Here, Y=0.048 inches. The modulus of elasticity E for steel is typically $30\times10^6$ lb/in$^2$. The area A (W·T) is 0.21 in$^2$. The area times the modulus (A·E)=$6.30\times10^5$ pounds. Multiplying this by the distance from the X axis, A·E·Y=$3.02\times10^4$ pound-inches. The neutral axis is $\overline{Y}$, and the distance from the neutral axis $(Y-\overline{Y})$ is $Y_a$. Here $Y_a$=−0.271 inches. The modulus of elasticity of carbon graphite fiber is about $19\times10^6$ lb/in$^2$. Preferably the material used for the stiffening plates in the ski of the present invention will have a modulus of elasticity in excess of $15\times10^6$ lb/in$^2$, although the need for this may vary depending on the density of the material. A material with a lower modulus of elasticity may be used if it is a less dense material. Whereas for a more dense material, a higher modulus of elasticity is preferred.

TABLE 1

| Element | Material | Width (inches) (W) | Thickness (inches) (T) | Distance from x-axis (in) (Y) | Modulus of Elasticity (lb/in$^2$) (E) | Area (in$^2$) (A) | AE (lb) | AEY (lb-in) | $Y_a$ (in) | $(Y_a)^2$ (in$^2$) | $AE(Y_a)^2$ (lb-in$^2$) | $EI_n$ (lb-in$^2$) | EI Total (lb-in$^2$) |
|---|---|---|---|---|---|---|---|---|---|---|---|---|---|
| 18 | Steel | 0.357 | 0.06 | 0.048 | 30.0E + 6 | 0.021 | 642.6E + 3 | 30.8E + 3 | −0.271 | 0.073 | 47.2E + 3 | 192.8E + 0 | 47.4E + 3 |
| 20 | Polyethylene | 2.4 | 0.05 | 0.025 | 300.0E + 3 | 0.120 | 36.0E + 3 | 900.0E + 0 | −0.294 | 0.086 | 3.1E + 3 | 7.5E + 0 | 3.1E + 3 |
| 22 | Fiberglass | 1.6 | 0.03 | 0.065 | 1.8E + 6 | 0.048 | 86.4E + 3 | 5.6E + 3 | −0.254 | 0.065 | 5.6E + 3 | 6.5E + 0 | 5.6E + 3 |
| 24 | Plastic | 2.4 | 0.49 | 0.36 | 800.0E + 3 | 1.176 | 940.8E + 3 | 338.7E + 3 | 0.041 | 0.002 | 1.6E + 3 | 18.8E + 3 | 20.4E + 3 |
| 26 | Fiberglass | 2.35 | 0.03 | 0.655 | 1.8E + 6 | 0.071 | 126.9E + 3 | 83.1E + 3 | 0.336 | 0.113 | 14.3E + 3 | 9.5E + 0 | 14.3E + 3 |
| 28 | Thermoplastic | 2.35 | 0.02 | 0.68 | 500.0E + 3 | 0.047 | 23.5E + 3 | 16.0E + 3 | 0.361 | 0.130 | 3.1E + 3 | 783.3E − 3 | 3.1E + 3 |
| 30 | Carbon Composite | 2.45 | 0.035 | 0.098 | 19.0E + 6 | 0.086 | 1.6E + 6 | 159.7E + 3 | −0.221 | 0.049 | 79.6E + 3 | 166.3E + 0 | 79.7E + 3 |
| 32 | Carbon Composite | 2.35 | 0.035 | 0.623 | 19.0E + 6 | 0.082 | 1.6E + 6 | 973.6E + 3 | 0.304 | 0.092 | 144.4E + 3 | 159.5E + 0 | 144.6E + 3 |
| | | | | | | | | | | | | Total | 3.18E + 05 |

The location of the neutral axis ($\overline{Y}$) is calculated as the sum of the values for A·E·Y divided by the sum of the values of A·E. Here, $\overline{Y}$ is 0.3186 inches from the reference X axis (the bottom of the ski). Thus $Y_a^2$=0.073 in$^2$, and $A \cdot E \cdot Y_a^2$= $4.62\times10^4$. $EI_n$=E·W·T$^3$/12, and here equals $1.92\times10^2$ lb-in$^2$. The stiffness coefficient (EI total) equals $E \cdot I_n + A \cdot E \cdot (Y_a)^2$ which is $4.64\times10^4$ lb-in$^2$.

The figures for the remaining materials can be seen from Table 1. The total stiffness coefficient is the total of the individual stiffness coefficients. As can be seen from Table 1, the total stiffness coefficient of the ski of the present invention in the mid-section of the ski is approximately 318,000 which is more than three times that of a conventional ski as shown by curve 125 in FIG. 2.

Furthermore, in the tail section of ski 10, the ski of the present invention has a much lower stiffness coefficient than that of a conventional ski. This is most easily seen from FIG. 8 where it can be seen that the stiffness at any point in the tail portion of ski 10 is generally less than ⅓ of the stiffness of a conventional ski at the same point. Further, the average stiffness of tail portion 16 of ski 10 is less than about ⅕ of the average stiffness of the tail section of a conventional ski.

The peak stiffness in the tail section of the ski of the present invention is no more than 15% of the peak stiffness in the mid-section of the ski. The peak stiffness coefficient in the tail section is preferably below 10%, more preferably below 5%, and, as shown in FIGS. 2 and 8, as low as 1/30 (3%) (or lower) of the peak stiffness coefficient in the body of the ski. This provides the ski with a very flexible tail section and a very stiff middle section, which provides optimal stability while allowing the tail section to flex to prevent knee injury and allow easier maneuvering of the ski.

While the ski of the present invention is shown with two graphite carbon fiber composite plates 30 and 32 for stiffness, any suitably stiff material can be used to stiffen the ski of the present invention including steel. Further, only one plate may need to be included if that plate is sufficiently stiff. However, two plates are preferred since they can be separated, resulting in a higher stiffness with lower weight than could be achieved with a single stiffening plate. Specifically, carbon graphite fiber is preferred because it is stiff and light weight, but metal alloys such as titanium and aluminum can be produced for a light weight stiff plates to be included in the ski. One skilled in the art would be able to develop suitably light weight and stiff plates for inclusion into the interior of the ski of the present invention.

As discussed, the tail section of the ski of the present invention is very flexible. Accordingly, tail portion 16 may be permanently damaged in a rearward fall. This is due to the extreme flexibility, such that a rearward fall could cause tail section 16 to be folded and broken. Accordingly, to prevent such permanent damage to the ski, as well as to achieve other goals, an alternative configuration of ski 10 is shown in FIG. 7.

Figure 7:
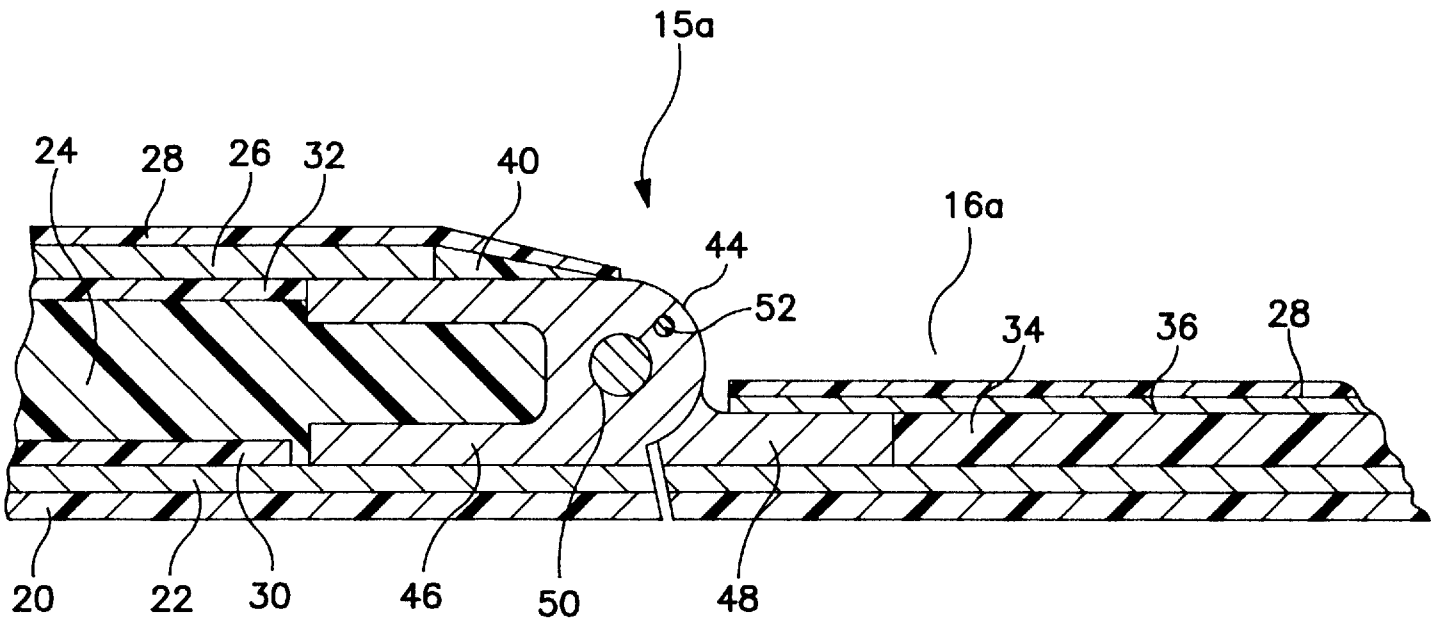
FIG. 7 is a cross-sectional view of an alternative embodiment of the ski of the present invention taken along the line 6—6 of FIG. 1.

FIG. 7 shows an alternative transition portion 15*a* which comprises hinge joint 44 including forward hinge 46 which is bonded to middle portion 14 of ski 10 and rearward hinge 48 bonded to tail portion 16 of ski 10. The hinge joint 44 also includes pivot pin 50 and shear pin 52. Preferably, hinge joint 44 is fashioned as a knuckle joint. Forward hinge 46 and rearward hinge 48 can be comprised of aluminum or other appropriate material including a laminated material. Pivot pin 50 can be made as part of rearward hinge 48 or forward hinge 46, or may be a separate material such as steel or aluminum. Shear pin 52 is formed of a suitable material which may be a metallic material such as aluminum or soft steel, or can be made of plastic or other suitable material which sill appropriately shear when a stress is placed on it.

In operation, pivot pin 50 couples forward hinge 46 to rearward hinge 48. The joint is kept from rotating by shear pin 52. During a rearward fall, when the load on tail portion 16 exceeds the ability of shear pin 52 to resist movement of rearward portion 48 of hinge 44 with respect to forward portion 46 of hinge 44, shear pin 52 will fail. When this occurs, there will be minimal resistance to operation of the hinge, and the tail section of the ski will fold with respect to middle portion 14 of ski 10. This serves several functions. First, the hinge helps reduce the likelihood of injury to a skier's knee by unloading the force through the hinge action once that force exceeds the physical capability of shear pin 52. Secondly, the hinge helps prevent damage to rear section 16 of ski 10. Finally, should soft rear section 16 of ski 10 be damaged, the ski may be separated at hinge 44 and rear portion 16 replaced without replacement of the entire ski 10.

It is understood that various other modifications will be apparent to one skilled in the art without departing from the spirit and scope of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed:

1. A ski having a front tip and a rear tail comprising:

a shovel portion adjacent said front tip, a middle portion, and a tail portion adjacent said rear tail, wherein said middle portion has a predetermined peak stiffness coefficient, and said tail portion has a peak stiffness coefficient which is less than 15 percent of said middle portion peak stiffness coefficient wherein said peak stiffness coefficient in said middle portion of said ski is at least about 200,000 lb-in$^2$.

2. A ski according to claim 1 wherein said tail portion comprises 25 percent of said ski length.

3. A ski according to claim 1 wherein said ski has camber of less than 0.6 centimeters.

4. A ski according to claim 1 wherein the average stiffness coefficient over said tail portion is less than 10 percent of the peak stiffness coefficient of said middle portion.

5. A ski according to claim 4 wherein the average stiffness coefficient over said tail portion is less than 5 percent of the peak stiffness coefficient of said middle portion.

6. A ski according to claim 1 wherein said peak stiffness coefficient in said tail portion of said ski is less than 20,000 lb-in$^2$.

7. A ski according to claim 6 wherein said ski further includes two carbon graphite fiber stiffening plates in said middle portion of said ski.

8. A ski having a front tip and a rear tail comprising:

a shovel portion adjacent said front tip, a middle portion, and a tail portion adjacent said rear tail;

a base extending along the lower surface of said ski;

a protective cosmetic layer extending along the upper surface of said ski; and a core extending between said base and said cosmetic layer;

wherein said middle portion further includes two stiffening plates, one said plate extending between said base and said core, and one said plate extending between said protective cosmetic layer and said core; and said stiffening plates are formed from a material having a modulus of elasticity in excess of $15\times10^6$ lb/in$^2$.

9. A ski according to claim 8 wherein said stiffening plates comprise carbon graphite fiber.

10. A ski according to claim 9 wherein said middle portion of said ski has a peak stiffness coefficient of at least about 200,000 lb-in$^2$.

11. A ski according to claim 10 wherein said tail portion of said ski has a peak stiffness coefficient of less than 20,000 lb-in$^2$.

12. A ski according to claim 8 further comprising:

a hinge joint between said middle and tail portions, said hinge joint including a shear pin.

13. A ski according to claim 8 further comprising a shear block between said middle and tail portions.

* * * * *